US011946011B1

(12) United States Patent
Perlman

(10) Patent No.: US 11,946,011 B1
(45) Date of Patent: Apr. 2, 2024

(54) STABILIZED MEDIUM CHAIN TRIGLYCERIDE-BASED HOUSEHOLD LUBRICANT AND PROTECTIVE COATING

(71) Applicant: Perlman Consulting, LLC, Arlington, MA (US)

(72) Inventor: Daniel Perlman, Arlington, MA (US)

(73) Assignee: PERLMAN CONSULTING, LLC, Arlington, MA (US)

( * ) Notice: Subject to any disclaimer, the term of this patent is extended or adjusted under 35 U.S.C. 154(b) by 0 days.

(21) Appl. No.: 17/976,245

(22) Filed: Oct. 28, 2022

(51) Int. Cl.

| | |
|---|---|
| ***C10M 169/04*** | (2006.01) |
| ***C10M 105/36*** | (2006.01) |
| ***C10M 129/06*** | (2006.01) |
| *C10N 30/00* | (2006.01) |
| *C10N 30/02* | (2006.01) |
| *C10N 30/10* | (2006.01) |
| *C10N 40/34* | (2006.01) |
| *C10N 50/04* | (2006.01) |

(52) U.S. Cl.
CPC ..... *C10M 105/36* (2013.01); *C10M 129/06* (2013.01); *C10M 169/04* (2013.01); *C10M 2207/021* (2013.01); *C10M 2207/123* (2013.01); *C10M 2207/124* (2013.01); *C10M 2207/2825* (2013.01); *C10N 2030/02* (2013.01); *C10N 2030/10* (2013.01); *C10N 2030/40* (2020.05); *C10N 2030/64* (2020.05); *C10N 2040/34* (2013.01); *C10N 2050/04* (2013.01)

(58) Field of Classification Search
CPC ..... C10M 105/36; C10M 129/06; C10M 169/04; C10M 2207/021; C10M 2207/123; C10M 2207/124; C10M 2207/2825; C10N 2030/02; C10N 2030/10; C10N 2030/40; C10N 2030/64; C10N 2040/34; C10N 2050/04
See application file for complete search history.

(56) References Cited

FOREIGN PATENT DOCUMENTS

| | | | | |
|---|---|---|---|---|
| CN | 110522690 B | * | 9/2022 | ..... A61K 8/31 |
| EP | 3421096 A1 | * | 1/2019 | ..... A61K 8/11 |
| KR | 1020190129143 A | * | 11/2019 | |

OTHER PUBLICATIONS

Fox et al. Vegetable oil-based lubricants-A review of oxidation. Tribology International, 40, 2007, 1035-1046.
Wikipedia. WD-40. 2019. 1-4. https://en.wikipedia.org/wiki/WD-40.

* cited by examiner

*Primary Examiner* — Taiwo Oladapo
(74) *Attorney, Agent, or Firm* — ARRIGO, LEE, GUTTMAN & MOUTA-BELLUM LLP

(57) ABSTRACT

Household lubricant compositions containing medium chain triglycerides are non-toxic and biodegradable. The lubricant compositions are made using vegetable oil components and stabilized using alcohol, an antioxidant, and a metal chelator. The lubricant compositions offer safe and environmentally friendly alternatives to petroleum-based lubricants, yet have similar lubricity and are more stable than naturally sourced vegetable oils. The compositions also can be used to clean and coat surfaces, including food preparation surfaces, and to prevent corrosion. Still further uses include sterilization and sanitation of surfaces and as a skin conditioner and lubricant.

25 Claims, No Drawings

STABILIZED MEDIUM CHAIN TRIGLYCERIDE-BASED HOUSEHOLD LUBRICANT AND PROTECTIVE COATING

BACKGROUND

Household lubricating, coating, and cleaning oils that can silence a squeaky door hinge, displace water, or lubricate a saw blade and protect it from rusting have existed for many decades. However, these household lubricants typically are petroleum-based products that can be toxic and may even be fatal if ingested in sufficient amounts. Eye contact and breathing of aerosolized petroleum-based oils is considered hazardous, and even skin contact can be harmful. Household lubricating oils may also contain additives or unknown contaminants that can contribute to toxicity. Some household lubricants, coatings, and cleaners contain organic additives that can have long-term toxicity and may be poorly biodegradable. For example, persistent organic pollutants (POPs) such as polyfluoroalkyl substances (PFAS), perfluorooctanoic acid (PFOA), and perfluorooctane sulfonate (PFOS) and their precursors have spread to the far-reaches of the Earth while showing toxicity at very low concentrations and high resistance to biodegradation pathways.

Households are often in need of a convenient spray lubricant for use inside and outside the house. When bringing a household lubricant into a living space, a consumer ideally should feel confident that the lubricant is safe inside the living space. The consumer should be able to safely use the lubricant for a spray application, for example, in a living space later occupied by children and pets. In some uses, the lubricant should be safe for skin contact and for cleaning or sterilizing food contact surfaces. Ideally, the lubricant should leave no long-term unpleasant odors in the house after application and should remain stable. Nevertheless, previous attempts to use natural oils as lubricants have been troubled by their lack of stability against common environmental factors, such as oxygen and metals, which promote rapid oxidation and degradation of most natural oils and fats. There is a need for household lubricants and cleaning oils that do not pose toxicity or biodegradability concerns while providing a quick, reliable solution for various household needs, and are stable in storage and in use over long periods of time.

SUMMARY

The present technology provides stabilized, non-toxic medium chain triglyceride (MCT) based lubricant and coating compositions that can be sprayed or applied to household objects. The lubricant compositions can be used for lubricating, sterilizing, cleaning, and coating surfaces and can even be applied to skin. Uses of the compositions include, for example, prevention of rust or oxidation of metal parts, elimination of squeaks in moving parts, cleaning and protection of wood surfaces, and skin conditioning and lubrication. The compositions can be safe and non-toxic, making them suitable for use on food preparation surfaces such as cutting boards and counter surfaces. The lubricant compositions can also be used to disinfect surfaces or skin.

The present MCT lubricant and coating compositions have advantages over the use of petroleum-based lubricants and over the use of plant-derived oils. Compared to petroleum-based lubricants, the present MCT compositions offer similar lubricity but lack toxicity and can be readily biodegraded. The present MCT compositions offer a much better safety profile, and can even be prepared with food-grade components for safe use on food preparation surfaces and equipment. The preferred solvents used to adjust the viscosity of the MCT compositions, which are anhydrous alcohols such as ethanol, propanol, and isopropanol, provide a stable solution and are also non-toxic if ingested in small amounts. Compared to naturally sourced vegetable oils, the present MCT compositions offer equivalent safety, non-toxicity, and biodegradability, yet provide vastly superior stability against oxidation. Thus, for lubrication uses the present technology has achieved a superior combination of lubricity, safety, non-toxicity, biodegradability, storage stability, and stability against oxidation. For use as a coating agent and conditioner for surfaces including wood and even skin, the present technology has achieved a superior combination of bio-friendly ingredients that offer stability, protection against oxidation, protection against water intrusion, and biocompatibility. These features result from the serendipitous selection and compatibility of components of the composition.

The present technology can be further summarized by the following features.

1. A Chemically Stabilized Lubricant and Coating Composition Comprising:
   - (i) a medium chain triglyceride (MCT) oil at a concentration of from about 20 weight percent to about 80 weight percent;
   - (ii) anhydrous alcohol at a concentration of from about 20 weight percent to about 80 weight percent, wherein the anhydrous alcohol is selected from the group consisting of ethanol, n-propanol, and isopropanol;
   - (iii) an antioxidant at a concentration of from about 50 to about 500 ppm; and
   - (iv) a metal chelating agent at a concentration of from about 20 to about 200 ppm;

wherein the melting point of the composition is below 0° C.; wherein the kinematic viscosity of the composition is less than about 20 centiStokes (cSt) at 40° C. or less than about 40 cSt at 20° C.; and wherein the composition forms a single homogeneous phase at ambient temperature.

2. The lubricant and coating composition of feature 1, wherein the weight ratio of the MCT oil to the anhydrous ethanol is from about 1:4 to about 4:1.

3. The lubricant and coating composition of feature 1 or feature 2, wherein the MCT oil consists essentially of triglycerides having a fatty acid composition of about 20% to about 98% by weight caprylic acid (C8:0), 0% to about 60% by weight capric acid (C10:0), and 0% to about 20% by weight lauric acid (C12:0), wherein the total of said caprylic acid, capric acid, and lauric acid is 100%.

4. The lubricant and coating composition of feature 3, wherein the weight ratio of C8:0 to C10:0 fatty acids is from about 50:1 to about 1:4.

5. The lubricant and coating composition of feature 3, wherein the weight ratio of C8:0 to C10:0 fatty acids is from about 2.5:1 to about 1:2.

6. The lubricant and coating composition of feature 3, wherein the triglycerides are essentially devoid of lauric acid (C12:0).

7. The lubricant and coating composition of any of the preceding features, wherein the melting point of the composition is about −4° C. or lower.

8. The lubricant and coating composition of any of the preceding features, wherein the anhydrous alcohol is anhydrous ethanol or denatured ethanol.

9. The lubricant and coating composition of any of the preceding features, wherein the MCT oil, antioxidant, and metal chelating agent are food grade.

10. The lubricant and coating composition of any of the preceding features, wherein the antioxidant comprises BHA, BHT, TBHQ, propyl gallate, or a combination thereof.

11. The lubricant and coating composition of feature 10, wherein the antioxidant is TBHQ present in the composition at a concentration of about 50 ppm to about 200 ppm.

12. The lubricant and coating composition of any of the preceding features, wherein the metal cation chelating agent comprises citric acid, malic acid, glycolic acid, lactic acid, tartaric acid, ethylenediaminetetraacetic acid (EDTA), or a combination thereof.

13. The lubricant and coating composition of any of the preceding features, wherein the metal cation chelating agent is citric acid present in the composition at a concentration of about 50 ppm to about 100 ppm.

14. The lubricant and coating composition of any of the preceding features, wherein the composition is suitable for aerosol delivery or delivery by mechanical pump sprayer.

15. The lubricant and coating composition of any of the preceding features, wherein the composition is biodegradable, non-toxic, and suitable for use as a household lubricant.

16. The lubricant and coating composition of any of the preceding features, wherein the composition is suitable for use as a protectant coating of wood or metal articles and/or as a penetrating lubricant.

17. The lubricant and coating composition of any of the preceding features, wherein the composition is suitable for use as a cleaning agent of wood or metal articles.

18. The lubricant and coating composition of any of the preceding features, wherein the composition is suitable for use as a skin lubricant.

19. The lubricant and coating composition of any of the preceding features, wherein the antioxidant remains soluble in the MCT oil after evaporation of the ethanol.

The lubricant and coating composition of any of the preceding features, wherein the composition consists essentially of said MCT oil, anhydrous ethanol, antioxidant, and metal chelating agent.

21. A lubricant aerosol delivery device, wherein the device comprises the lubricant and coating composition of any of the preceding features and an aerosol propellant packaged in a sealed container.

22. The aerosol delivery device of feature 21, wherein the propellant comprises nitrogen, carbon dioxide, nitrous oxide or a combination thereof.

23. A lubricant spray delivery device, wherein the device comprises the lubricant and coating composition of any of features 1-20 packaged in a pump spray container.

24. A method of lubricating, coating, cleaning, sterilizing, preserving, conditioning, or displacing water from an object or a surface, wherein the method comprises contacting the object or surface with the lubricant and coating composition of any of features 1-20.

25. The method of feature 24, wherein the lubricant and coating composition is provided in an aerosol or pump spray delivery device, and wherein the contacting comprises spraying the composition on the object or surface and allowing the anhydrous ethanol to evaporate.

26. The method of feature 24, wherein the object is selected from the group consisting of door hinges, locks, zippers, exercise equipment, rusted parts, toys, bicycle or motorcycle chains, tools, boats, automobiles, and appliances.

27. The method of feature 24, wherein the surface is a countertop, food preparation surface, or skin surface.

The lubricants of the present technology are based on a specific class of triglyceride compounds called medium chain triglycerides (MCTs). Triglycerides, which are found in natural sources such as plant oils, contain a glycerol backbone esterified to three fatty acid chains. Glycerol is a backbone found in lipids known as glycerides or triglycerides. Glycerol is also known as propanetriol, 1,2,3-propanetriol, 1,2,3-trihydroxypropane, glycerine, glycerin, or propane-1,2,3-triol. Glycerol is represented in formula 1.

formula 1

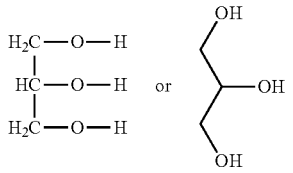

MCTs contain glycerol and medium-chain fatty acids (MCFAs), which are fatty acids having from 6 to 12 carbon atoms. In MCTs, of the three fatty acids, two or three are MCFAs. MCTs can contain a mixture of different MCFAs and can contain a small amount of shorter or longer chain length fatty acids. In contrast to MCFAs, short-chain fatty acids contain five or fewer carbons, and long-chain fatty acids contain 13 to 21 carbons. Very long chain fatty acids contain 22 or more carbons. MCT oils for use in the present technology are liquid at ambient or "room" temperature. As used herein, "ambient temperature" or "room temperature" is about 15-40° C., or about 15-30° C., or about 20-25° C. The freezing temperature of a specific oil can be over a temperature range. As some oils are cooled to lower temperature, some oils can turn cloudy or can form a jelly-like substance before freezing. As used herein, "freezing point" is the temperature at which a liquid turns into a solid when cooled. A solid is a state that does not readily flow or readily take the shape of its container and that is characterized by structural rigidity and resistance to a force applied to the surface. Some saturated fats are poorly suited for use as household lubricants because they are solid at room temperatures, for example, lard, tallow, coconut, and palm oil. However, lubricants of the present technology are liquid down to at least 0°, or down to at least −4° C., or down to at least −10° C.

Propylene glycol is a backbone found in some lipids. Such lipids can be produced by esterification of various fatty acids with the two hydroxyl groups of propylene glycol. Propylene glycol is widely used in cosmetics. Propylene glycol is also known as propane-1,2-diol, α-propylene glycol, 1,2-propanediol, 1,2-dihydroxypropane, methyl ethyl glycol, and methylethylene glycol. Medium chain propylene glycol oils (MCPG oils) can be formed by esterification of MCFAs with propylene glycol. Propylene glycol is represented in formula 2.

formula 2

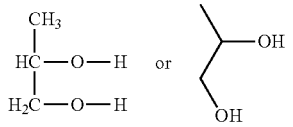

The term "biodegradable" refers to substances, such as lubricants, that can degrade to simpler molecular substances such as fatty acids, alcohols, carbon dioxide and water, and in the case of polymer molecules degrade fully, e.g., to monomeric or even simpler molecular species under composting or other natural decomposition processes involving the action of bacteria or other living organisms, including fungi, and components thereof, such as enzymes. Long-term composting means composting for greater than about six months, greater than about one year, or greater than about two years. Composting can be in a commercial or industrial setting or in a community based (eco-friendly) composting site, or for example, in a backyard compost pile or a rotatable backyard composter container. Composting can involve gathering a mix of greens and browns. Greens are, for example, materials including nitrogen such as leaves, grass, and food scraps. Browns are, for example carbon-like stalks, paper, and wood chips containing cellulose. The combined materials are initially wetted to begin to break them down into a humus, a process that can occur over a period of months. The final compost is often used as a fertilizer in a garden, assuming the final compost does not contain toxic ingredients (e.g., lead or other heavy metals). Various enzymes can be present in the compost humus. Biodegradation pathways break down materials during composting. Biodegradable lubricants are not necessarily hydrolytically degradable and may require enzymatic action to fully degrade.

As used herein, the term "electromagnetic radiation" can include radio waves, microwaves, infrared (IR), visible light, ultraviolet (UV), high-energy electrons or an electron beam, X-rays, or gamma rays.

The term "hydrophobic," as used herein, refers to the property of lacking affinity for water, or tendency to displace or repel water, or to fail to mix with water. For example, the more hydrophobic a compound is, the more that compound tends to not be wetted by water.

The term "hydrophilic," as used herein, refers to the property of having affinity for water. Compounds having hydrophilic properties can, for example, have hydrogen bond accepting chemical functional groups, to which water can form hydrogen bonds.

As used herein, lubricity is the measure of the reduction in friction and or wear by a lubricant. The study of lubrication and wear mechanisms is called tribology. Lubrication is the control of friction and wear by introducing a friction-reducing film between moving surfaces otherwise in contact with one another. This film, or lubricant, can be a solid, fluid, or plastic substance, with oil and grease being the most common. Lubricants can reduce friction, prevent wear, protect from corrosion, coat and protect surfaces from rust, oxidation, or other forms of degradation. Lubricants also can provide skin treatment, conditioning, or lubrication, prevent stains or contamination of underlying materials, displace water, and provide a fluid seal.

Saturated fatty acids have no carbon-carbon double bonds (C═C). They have the same formula $CH_3(CH_2)nCOOH$, with variations in "n" ranging from about 6 to about 22. A common saturated fatty acid is stearic acid (n=16, total number of carbons=18, also referred to as a "C18" fatty acid. Typically, a saturated fatty acid is denoted by the number of carbons 'C' (18 for stearic acid), a colon ':', and the number of double bonds '0' (0 for stearic acid). Stearic acid can thus be denoted as C18:0. Some other common fatty acids are: caproic acid (Hexanoic acid), $CH_3(CH_2)_4COOH$, or C6:0; enanthic acid (heptanoic acid), $CH_3(CH_2)_5COOH$, or C7:0; caprylic acid (octanoic acid), $CH_3(CH_2)_6COOH$, or C8:0; pelargonic acid (nonanoic acid), $CH_3(CH_2)_7COOH$, or C9:0; capric acid (decanoic acid), $CH_3(CH_2)_{8000}H$, or C10:0; undecylic acid (undecanoic acid), $CH_3(CH_2)_9COOH$, or C11:0; and lauric acid (dodecanoic acid), $CH_3(CH_2)_{10}COOH$, or C12:0. The fatty acids of MCTs are most commonly C8:0, C10:0, and C12:0, because the odd-carbon numbered fatty acids (e.g., C7:0, C9:0, and C11:0) are less common. The MCT compositions disclosed herein can include one or more of C6:0, C7:0, C8:0, C9:0, C10:0, C11:0, and C12:0, all of which are medium-chain fatty acids and can be esterified to form various MCTs.

As used herein, unsaturated fatty acids have one or more C═C double bonds. The C═C double bonds can provide either cis or trans isomers.

As used herein, the terms "highly pure" and "high purity" are defined as a material having a purity of about 95-100%, 96-100%, 97-100%, 98-100%, 99-100%, 99.9-100%, 99.99-100%, or 99.999%-100%.

As used herein, an "absolute" or "anhydrous" solvent refers to a solvent containing not more than about 1% water; preferably they contain less than 0.5%, or less then 0.4%, or less than 0.3%, or less than 0.2%, or less than 0.1% water. As used herein an "essentially anhydrous", "about absolute", or an "about anhydrous" solvent refers to a solvent containing not more than about 5% water.

As used herein, the term "about" refers to a range of within plus or minus 10%, 5%, 1%, or 0.5% of the stated value.

As used herein, "consisting essentially of" allows the inclusion of materials or steps that do not materially affect the basic and novel characteristics of the claim. Any recitation herein of the term "comprising", particularly in a description of components of a composition or in a description of elements of a device, can be exchanged with the alternative expression "consisting of" or "consisting essentially of".

DETAILED DESCRIPTION

The present technology provides stabilized, non-toxic lubricant and coating compositions based on medium chain triglyceride oil (MCT oil). The compositions can be applied, preferably by spraying, for a variety of general uses, such as lubricating, coating, sterilizing, and/or cleaning of household objects with moving parts or with metal, wood, or plastic surfaces. The compositions including the MCT-based lubricants can also be formulated as an antimicrobial skin sanitizer and cleaner.

The lubricant and coating compositions of the present technology can, for example, contain at least about 20%, or at least about 30% or at least about 50%, or up to about 80% by weight of MCT oil, which contains a number of related triglyceride molecular species having "medium chain", saturated fatty acids esterified to a glycerol backbone. The saturated fatty acid-containing triglycerides include medium chain triglycerides (MCTs). The MCTs can be, for example, about 20% to about 98% or about 20% to about 80% or about 30% to about 60% or about 20% to about 40% by weight caprylic acid (C8:0), about 0% to about 80% or about 10% to about 60% or about 20% to about 40% by weight capric acid (C10:0), and 0% to about 20% or about 5% to about 10% by weight lauric acid (C12:0), wherein the total of caprylic acid, capric acid, and lauric acid is 100%. A solvent is added to the saturated fatty acid-containing triglycerides, for example, to facilitate aerosol or spray pump application of the compositions and to reduce molecular oxygen entry and solubility in the MCT oil.

Pure MCT oil is generally unsuitable for application as a lubricant or coating composition because it is too viscous, making it difficult to apply evenly or to reach into small spaces. Therefore, the MCT compositions of the present technology are diluted with a suitable solvent to obtain a lower viscosity, at which the compositions can be conveniently applied by spraying. The dynamic viscosity of the present compositions is preferably less than about 100 millipascal seconds (mPa·s) at 20° C., alternatively expressed in kinematic viscosity units as approximately 100 Centistoke units (abbreviated cSt) at 20° C., or less than about 50 cSt at 20° C., or less than about 40 cSt at 20° C., or less than about 30 cSt at 20° C., or less than about 20 cSt at 20° C., or less than about 10 cSt at typically 20° C. or 40° C. A lower viscosity is preferred for use in a spray pump or aerosol spray application.

Viscosity is a measure of a fluid's resistance to deformation or sheer stress. It is a measure of the "thickness" of a liquid. For example, kinematic viscosity can be measured in Centistoke units for example, at about 20° C. Water at 20° C. has a kinematic viscosity of approximately 1.0 cSt. The centistoke (cSt) and milliPascal second units are alternative units of kinematic and dynamic viscosities respectively. While various known instruments and methods exist for measuring viscosity, a common method involves a drip cup, which is filled with the liquid to be measured and includes a small hole in the bottom of the cup. The measurement involves measuring the amount of time required for the liquid to fall out of the hole of the cup, and the time is compared to a reference table.

As the viscosity of a fluid increases, it will tend to form larger droplets when sprayed from a spray pump or an aerosol sprayer. For very viscous fluids, this can have a detrimental effect on coating applications, as small droplets sizes are favored in order to ensure an even coating. In order to dispense higher viscosity fluids, the fluid pressure can be increased during spraying, as increased pressure will reduce the droplet size; however, spraying at higher pressures also increases the flow rate, making the spray difficult to control and possibly raising a safety concern.

After application of the compositions to a surface or object, the solvent in the composition evaporates, leaving behind the MCT oil and any other non-volatile components of the composition. The residual oil can be, for example, odor free for general household use; alternatively, a fragrance can be added for use in tracking the applied lubricant or coating, or to please the user. A bottle of the compositions disclosed herein can be kept handy in the household to silence a squeaky door hinge, squeaky exercise equipment, or to clean a stovetop. The bottle provides a worry free, "green" solution compared to past petroleum-based household lubricants, which also may contain volatile solvents that can contaminate household air.

The presence of long chain fatty acids in a triglyceride can be associated with susceptibility to oxidation, which is a serious problem with use of vegetable oils as lubricants or coatings. Use of MCT oil reduces this susceptibility to oxidation compared to vegetable oil; however, long chain fatty acids also should be kept to a low level, or avoided altogether, in the MCT-based compositions of the present technology. MCTs typically are produced by interesterification reactions or re-esterification reactions, such that the total population of fatty acids becomes rearranged and reassembled into new triglyceride molecules. Generally, MCTs do not contain long chain fatty acids, although a low level can be added during the interesterification or re-esterification reactions. The lack of long chain fatty acids provides higher oxidative stability, a long shelf life, and a lack of rancidity.

Hydrolytic processing of palm kernel oil or coconut oil with specifically targeted fractional distillation can provide substantial quantities of purified single species or mixed species of medium chain fatty acids (MCFAs). Selective re-esterification of these purified MCFAs with glycerol can be used to produce the reconstituted triglyceride oils known as MCTs. These MCTs can contain either single species or mixed species of 12, 10, and/or 8 carbon fatty acids. The weight ratios of 8, 10, and 12 carbon fatty acids in MCT oils can be tailored to the various physical and chemical properties required. Preferred weight ratios of C8:0 to C10:0 fatty acids are from about 50:1 to about 1:4, or from about 2.5:1 to about 1:1. In some embodiments, the MCT oil of the composition is essentially devoid of lauric acid (C12:0).

MCT oils containing approximately 60:40, 70:30 or 98:2 weight ratios of caprylic acid to capric acid are commercially available in nutritional supplements. Re-esterification of the same MCFAs with propylene glycol rather than glycerol can produce defined medium chain propylene glycol oils (MCPG oils) having two rather than three fatty acids per molecule. Palm oil, as compared to palm kernel oil, typically contains higher proportions of long chain fatty acids and is not readily suitable for the production of highly pure MCFAs. During production of MCTs, if interesterification, refinement, or re-esterification reactions are performed with long chain fatty acids replacing the medium chain fatty acids, highly pure MCTs suitable for the present technology will not be produced.

The fatty acids in sunflower and olive oils contain an unsaturated carbon-carbon bond (mostly C18:1 oleic acid) that is expected to increase their susceptibility to oxidative degradation. By comparison, MCT oils contain only saturated fatty acids that have little susceptibility to oxidation. This resistance to oxidation favors use of the MCT oil over sunflower oil and olive oil for household lubricant applications.

The testing of highly pure MCT oils for lubricity is described in Example 2 and Table 1 below. The lubricity measurements showed that lubricants containing about 99% MCTs, that have not been enzymatically modified or interesterified with any other non-medium chain triglycerides, have lubricities about equal to those of conventional commercial petroleum based lubricants (Table 1).

The technology disclosed herein also can provide a composition for topical skin care use. An example is a solution that includes MCT oil plus anhydrous (also referred to as "absolute") ethanol for anti-microbial disinfectant action (antibacterial. antiviral, and/or antifungal). The present MCT based compositions also can be used for disinfecting surfaces, including food contact surfaces and food preparation surfaces, as well as surfaces exposed to microbes and to touching by persons in a household or a public space. The liquid MCT-based lubricant compositions can contain at least about 20% by weight, at least about 30% by weight, at least about 40% by weight, at least about 50% by weight, at least about 65% by weight or up to about 80% by weight MCT oil, together with about 20% to 80% by weight anhydrous ethanol, or another anhydrous alcohol that is either non-toxic or minimally toxic and also miscible with MCT oils, such as anhydrous isopropyl alcohol. For use as a disinfectant of skin or other surfaces, the alcohol serves the roles of solubilizing the MCT oil and reducing the viscosity of the solution, as well as providing antibacterial, antiviral, and antifungal activity. When utilized for topical skin care, cleansing, sterilization, hand sanitizing, skin conditioning, and/or skin lubrication, the hand-feel of the compositions preferably is not sticky or tacky (see Example 1). TBHQ and optionally benzalkonium chloride (BC) that are soluble in alcohol and/or MCT oil can be added to provide anti-oxidant properties (TBHQ) or can enhance anti-microbial properties (BC); the latter is a component that is commonly utilized in hand sanitizing and skin care compositions.

The present MCT based compositions can have additional ingredients, beyond MCT oil and anhydrous ethanol or another anhydrous alcohol. For example, additional ingredients can include UV-blocking agents (for us as a sunscreen), emulsifiers, paraffin, methyl cellulose, glycol stearate, triethanolamine, glyceryl stearate, phenoxyethanol, petrolatum, cetyl alcohol, magnesium aluminum silicate, methylparaben, dimethicone, stearic acid, glycerin, carbomer, fragrance, EDTA or other metal chelators, colorants, and keratin or other proteins or peptides. The compositions herein can include higher amounts of alcohol or another solvent, for example, 80%, 90%, or 95% by weight, for broader and more effective antimicrobial use. To obtain antifungal properties, certain alcohols may be used at higher concentrations. One or more antifungal agents may be added to the compositions disclosed herein. In an embodiment, a denaturing agent such as isopropyl alcohol and a bitter taste agent such as denatonium benzoate or Bitrex can be added to discourage ingestion or abuse of ethanol, and may be added to the MCT composition. Under CFR Section 21.37 the specially denatured alcohol formula No. 3-C containing 5 parts isopropyl alcohol added to every 100 parts absolute ethanol can be used in commerce in solvents, cleaning solutions, disinfectants and other miscellaneous solutions for example.

With regard to loss of lubricity, triglycerides are known to be subject separately to oxidative degradation and degradative hydrolysis (de-esterification) by a variety of environmental conditions and chemical contaminants. However, the present MCT based composition mixtures are remarkably well stabilized against such degradations, particularly when compared to naturally occurring vegetable oils. The oxidation status of MCTs can be assessed by known measurements such as, for example, standardized Active Oxygen Method (AOM) tests performed at approximately 100° C. Using this method, the so-called "induction period" for any triglyceride-based oil can be measured. This induction period is the incubation time (at a preselected temperature) required for an edible oil to commence rapid acceleration of oxidative breakdown. Standard AOM values for the MCT oils described in Examples 1-2, measured according to the AOCS (American Oil Chemists' Society) Official Method Cd 12-57 (i.e., times measured at 100° C. for a 20 mL sample to reach a peroxide value of 100 meq/kg oil), are approximately 500 hours at 100° C. Thus, MCT oils for use in the present technology possess high oxidative stability compared with the far lower AOM values of 49 hours for commercial palm oil and 16 hours for canola oil (see, e.g., Anwar et al., *JAOCS.* 80, 151-155, 2003). The AOM value for olive oil, which contains a high level of monounsaturated oleic acid, is 31 hours (Läubli, M. W. & Bruttel, P. A., J. Am. Oil Chem. Soc. 63, 792-793, 1986). Because all of the fatty acids in MCT oils are saturated, MCT oils have high oxidative stabilities, with ten- to thirty-fold greater AOM values compared to common vegetable oils.

The choice of anhydrous ethanol, anhydrous propanol, or anhydrous isopropanol as solvent in the present MCT lubricant and coating compositions has a surprisingly beneficial effect in limiting or preventing MCT oxidation because oxygen is poorly soluble in ethanol and other alcohols including propanol and isopropanol when compared to its solubility in MCT oil itself. Other solvents, including alkanes for example, have a higher dissolved oxygen content when exposed to air. Thus, the use of anhydrous preparations of ethanol, propanol, or isopropanol as solvent for MCT oil has the beneficial effect of limiting oxygen exposure to the MCTs and extends the stability and shelf life of the present MCT lubricant and coating compositions compared to the use of other solvents.

Dilution of MCT oil with a solvent is needed in order to reduce its viscosity for easier and more uniform application of the present MCT compositions. However, it is important that the MCT-solvent mixture form a single, homogeneous, and stable liquid phase; separation of the mixture into two or more phases, or the formation of an emulsion will result in an unusable product for lubrication or coating. Here, the selection of alcohols such as anhydrous ethanol, propanol, or isopropanol is again fortuitous, because such solvents form a stable single liquid mixture with MCT oil over a wide range of MCT:alcohol ratios. Nevertheless, it was discovered that surprisingly small concentrations of water led to the separation of phases or formation of emulsions with such mixtures. In achieving the alcohol co-solvent benefit of limiting dissolved oxygen in mixtures of MCT and alcohol, it was experimentally determined that remarkably small amounts of moisture in mixtures of MCT and alcohol cause the loss of solvent miscibility, so that anhydrous alcohols must be utilized. For example, at room temperature the added presence of 1-2% by weight water in anhydrous 1:1 MCT-ethanol mixtures and 2-4% by weight water in 1:1 MCT-isopropanol mixtures was sufficient to cause loss of miscibility, with visible clouding and phase separation between the MCT and alcohol components then occurring. This undesirable loss of miscibility was found to occur at even lower water contents in MCT-alcohol mixtures when the temperature of the mixtures was decreased from 20° C. to 4° C. Surprisingly, it was found that, unlike with MCT oil, anhydrous ethanol has essentially no miscibility when added to conventional anhydrous vegetable oils such as corn and soybean oils and therefore no oxygen-limiting utility with such oils.

The absence of water from the MCT lubricant and coating compositions is only required during storage and during application of the compositions to parts needing lubrication or to a surface to be coated. After application, the composition of the application may change, in that the alcohol can evaporate partially or completely, leaving the MCT oil at the location where applied to perform its lubrication or coating function. Uptake of water into the composition during and after application is unlikely, due to evaporation of the alcohol and negligible solubility of water in MCT oil. Stabilizers such as antioxidants and metal chelators preferably remain at least partially soluble in the MCT oil during and after evaporation of the alcohol, thereby providing durable protection against degradation of the MCT oil for an extended period of time in use.

In addition to increasing the oxidative stability of MCT oils by dissolving them in an anhydrous alcohol, the present technology utilizes further stabilizing agents to prevent MCT decomposition, which are added to the composition so as to ensure exceptional long-term stability when MCT is employed as a lubricant or as a coating. Key stabilizers are antioxidants and chelators. These agents together neutralize oxidants present in the environment and multivalent metal ions that can catalyze the decomposition of triglycerides and that are often present on objects or surfaces to be lubricated and/or coated. Typically, only small amounts of functional additives need be added to MCT lubricant compositions to serve as effective chemical protectants.

Because household lubricants are often applied to surfaces such as metals (e.g., iron, steel, copper, and aluminum), that can promote the gradual oxidation and/or hydrolysis of fatty acids, the MCT lubricants described herein are supplemented with one or more protective agents to extend the lubricant's working life on a surface. One or more primary and secondary antioxidants can be added to the MCT lubricants at levels that are considered food-safe under FDA guidelines or at higher levels if the lubricant is not applied to food contact surfaces. For example, the food-compatible, MCT oil-soluble antioxidant, tertiary butylhydroquinone (TBHQ), is widely used in vegetable oils under FDA guidelines at levels up to 200 ppm, or at levels between 50 and 100 ppm, between 100 and 200 ppm or at higher levels such as up to 500 ppm if not ingested. Similar levels can be appropriate for the antioxidants BHA, BHT, and propyl gallate, which can inactivate most reactive oxygen species. Further, because household lubricants are often exposed to oxidized metal surfaces (e.g., steel tools and household fixtures), the working life of MCT lubricants may be extended by addition of agents preventing hydrolytic decomposition.

As stated above, such decomposition may be catalyzed by a number of metals and their cations including, for example, iron, copper and aluminum and their associated multivalent cations, (e.g., $Fe^{3+}$, $Cu^{2+}$ and $Al^{3+}$). Hydrolytic damage to MCTs can be substantially reduced or even blocked by addition to the lubricant and coating compositions of low levels of multivalent metal ion chelators, for example, citric acid (e.g., added at levels—from about 50 to about 500 ppm or from about 100 to about 200 ppm), or similar levels of ascorbic acid, and/or tartaric acid. Other examples of metal ion chelators are ethylene diamine tetra-acetic acid (EDTA), pyridoxal isonicotinoyl hydrazone (PIH), N,N,N',N'-tetrakis (2-pyridylmethyl)ethylenediamine (TPEN), triethylene-tetramine (Trien), N,N-diethyldithiocarbamate (DeDTC), N'-[5-(Acetyl-hydroxy-amino)pentyl]-N-[5-[3-(5-aminopentyl-hydroxy-carbamoyl) propanoylamino]pentyl]-N-hydroxy-butane diamide (Deferoxamine), 3-hydroxy-1,2-dimethylpyridin-4(1H)-one (Deferiprone), and 4-(3,5-Bis(2-hydroxyphenyl)-1H-1,2,4-triazol-1-yl)benzoic acid (Deferasirox).

The presently described MCT based household lubricant compositions can be formulated to be edible and suitable for use on and around food contact surfaces. A number of antioxidant agents are FDA-approved for addition to edible vegetable oils. For example, the following antioxidants are well-known and accepted antioxidants and may be added separately or in combination to vegetable oils: BHA, BHT, TBHQ, propyl gallate and citric acid. Propylene glycol can be used as a carrier solvent to dissolve these agents and to add them at FDA-prescribed levels to natural, fractionated and interesterified vegetable oils including MCT oil. For example, Kemin Industries, Inc. (Des Moines, IA) produces a variety of antioxidant blends containing one or more of the above-listed antioxidants dissolved in propylene glycol that are suitable for addition to vegetable oils. One effective blend known as EN-HANCE® A129 combines 20% TBHQ with 10% citric acid dissolved in 70% by weight propylene glycol. The TBHQ is a primary antioxidant that limits reactive oxygen and free radical attack on the oil, together with citric acid, a secondary antioxidant and/or chelation agent that helps to inactivate contaminating metal ions such as copper, iron and aluminum cations, thereby limiting hydrolytic breakdown of the oil. Effective levels of these two antioxidants in a vegetable oil such as MCT oil that may be applied to a food preparation surface and remain consistent with FDA food regulations is approximately 200 ppm TBHQ and 100 ppm citric acid. While maintaining the solubility of this level of citric acid and other carboxylic acid chelators in vegetable oils including MCT oils may be difficult, the presence of ethanol in the presently described compositions assures the solubility of these chelation agents in the present compositions.

The cost of highly pure MCTs is greater than that of petroleum derived lubricants. Further, there is a general belief that all vegetable oils are relatively unstable when compared to petroleum lubricants, owing to their susceptibility to oxidation, polymerization, and/or hydrolysis with the concomitant release of fatty acids. Unsaturated fats can be susceptible to electromagnetic radiation (photooxidation) and attack by free radicals. Metal ions can catalyze the release of fatty acids from triglycerides. However, the MCT based lubricant compositions disclosed herein have an unexpectedly long shelf-life and stability in use, due to both the stability of MCTs themselves and to the addition of stabilizers as described above. The compositions containing MCT oils disclosed herein can have a shelf-life of at least one year, at least two years, at least three years, at least four years, or at least five years. As used herein, "shelf-life" refers to the period of time during which a material may be stored in a sealed container, not exposed to light, at ambient temperature, and still remain suitable for its intended use. Suitable for use means, for example, maintaining a viscosity suitable for delivery and/or a lubricity suitable for use as a lubricant. Because the MCT based compositions disclosed herein contain only saturated fatty acids, a solvent, an antioxidant, and a metal chelator, they have long shelf-life and high oxidative stability.

The strong intermolecular interactions among triglyceride molecules can result in poor lubricity properties at low temperatures, such as temperatures below room temperature, or at outdoor temperatures during cold seasons. For example, palm oil contains approximately equal amounts of monounsaturated oleic acid and saturated palmitic acid, and it has reasonable oxidative stability; it is therefore useful as a high temperature frying oil. However, palm oil solidifies near or just slightly below room temperature due to its high level of saturated fatty acids, i.e., palmitic acid. In addition to palm oil, other tropical vegetable oils including palm kernel oil and coconut oil, with high levels of saturated fatty acids, similarly suffer from elevated melting points (room temperature and above). Thus, unfractionated tropical oils are impractical as fluid lubricants because they melt near or somewhat above room temperature.

Given that vegetable oils containing high percentages of saturated fatty acids tend to have elevated melting points, it is remarkable that MCT oils and compositions of the present technology, with all of their fatty acids being saturated, have melting points that are lower than about 0° C. This adds significantly to the value of MCT oils as used herein since it enables them to function surprisingly well as lubricants even in cold environments.

Even though a monounsaturated vegetable oil such as high oleic sunflower oil is known for its oxidative stability, such oils can polymerize or oxidize to become gummy over weeks, months, and years of exposure to sunlight and air. While so-called saturated vegetable oils such as palm oil and palm kernel oil may be somewhat more resistant to oxidation (they contain about 50% or more of saturated fatty acids), as lubricants they are undesirably solid or at least semi-solid at room temperature, having slip and melting points in the range about 24-35° C. Therefore, saturated vegetable oils such as palm oil are not useful as household lubricants. However, in the present technology, MCTs can be exceedingly oxidation-stable and perform as lubricants much like a petroleum-derived straight chain aliphatic lubricating oil. MCTs remain liquid and free-flowing near 0° C., for example, with a melting point of about −4° C. When combined with a solvent such as anhydrous ethanol having a very low melting point (−114° C.), the melting point of such compositions can be considerably lower than about −4° C., lower than about −10° C., or lower than about −15° C. The melting point and oxidative stability of the present stabilized MCT based compositions make them useful as general household lubricants, unlike naturally occurring vegetable oils containing long chain saturated fatty acids (e.g., palm oil and palm kernel oil) with much higher melting points and significant susceptibility to de-esterification. Thus, the MCT oil-based compositions of the present technology are beneficial for lubricant applications in winter or in refrigerated environments.

A substantial amount, e.g., as much as about 1%, about 10%, about 20%, about 30%, about 40%, about 50%, about 60%, about 70%, about 80%, or even about 90% by weight of an inert and volatile viscosity modifier may be added as a miscible thinning agent for MCT oils to enable and/or improve aerosol spray delivery of the lubricant. The inert and volatile viscosity modifier can be, or can include, for example, anhydrous ethanol, 1-propanol, 2-propanol, or a combination thereof. Other low toxicity or non-toxic solvents may be used, and examples are directed to safety based on FDA or US pharmacopeia standards. When a lubricant composition as disclosed herein is sprayed or applied to a surface or object for lubrication or coating, the volatile viscosity modifier can quickly evaporate, leaving a non-toxic lubricant (essentially pure MCT oil, or MCT oil containing a small amount of antioxidant and/or metal chelator additives) remaining on the surface. As used herein, a non-toxic lubricant refers to a lubricant that is safe for skin contact or for food contact after solvent evaporation. For example, the FDA recognizes that high concentrations (e.g., ≥60% vol/vol to ≥75% vol/vol) of ethanol or isopropyl alcohol are safe for use in hand sanitizers ("Temporary Policy for Preparation of Certain Alcohol-Based Hand Sanitizer Products During the Public Health Emergency (COVID-19) Guidance for Industry", Updated Feb. 10, 2021, U.S. Department of Health and Human Services, Food and Drug Administration (FDA) Center for Drug Evaluation and Research). After application of a lubricant composition disclosed herein, most of the solvent evaporates, leaving behind MCT, which contains far less solvent (or essentially no solvent) than FDA limits that are still generally recognized as safe. In another example, a lubricant disclosed herein is utilized to clean a cutting board. After application to the cutting board, most of the solvent evaporates, leaving behind the MCTs and stabilizers. In the example wherein the solvent is ethanol, ethanol is regulated by the FDA as a food ingredient (i.e., additive) and is considered a Generally Recognized as Safe (GRAS) ingredient (21 C.F.R. 184.1293).

In embodiments of the present MCT compositions, the main ingredients of the composition are limited to MCT oil and a volatile, nontoxic solvent such as ethanol which serves as a viscosity modifier, antifreeze, co-solvent for metal chelators having limited solubility in MCT oil, and vehicle for aiding in dispensing the MCT oil. Other ingredients, including one or more antioxidant compounds and one or more metal chelators, as well as optional ingredients such as odorants, colorants, additional solvents, viscosity modifiers, thickeners, rust preventers, fats or oils, skin care substances, medications, and the like, are present at less than about 1%, less than about 0.5%, less than about 0.2%, or less than about 0.1% by weight. In such embodiments, higher amounts of additives can reduce stability or shelf-life, cause precipitation or phase separation, introduce toxicity, or alter the advantageous properties of the MCT oil in the composition. Long chain fatty acids longer, i.e., longer than C12:0 or in some embodiments longer than C10:0, as well as unsaturated fatty acids, should be considered as additives and their content minimized or avoided altogether. A freezing point above about 10° C., about 15° C., about 25° C., or about 30° C., can render the MCT composition unsuitable for use as a liquid household lubricant composition.

Applying or spraying the compositions can be accomplished, for example, with pre-packaged wipes, with a dropper or droplet bottle, or pump bottle, or with an aerosol or pump spray container. The compositions can be used to sterilize and to clean a surface. The MCT based compositions disclosed herein can be supplied in a container of pre-saturated wipes. Each of the pre-saturated wipes can be used to sterilize skin or household surfaces or other objects, such as the interior of a car, a baby seat, or utensils. The pre-saturated wipes can be disposable and configured for one-time use, such as a sanitary wipe. The compositions can be provided in a bottle, such as a plastic or glass bottle. The bottle can include a spill-proof lid, a pump spray, or an applicator.

The present technology further provides a method for preventing oxidation of a surface. The method includes application of a layer of the MCT composition upon the surface.

If a household surface has been previously lubricated or coated with a layer of petroleum based material, or coated with conventional vegetable oils that have caked, polymerized and/or rancidified (e.g., wooden salad bowls and cutting boards), the present MCT compositions can be applied to the surface whereby the combination of alcohol and MCT oil (providing both hydrophilic and hydrophobic solvency) can strip away, remove, or dilute the pre-existing material, thereby decreasing the amount of unsightly residue and/or any accompanying toxicity from previous coatings. In certain instances, some household surface toxins are hydrophobic and not easily displaced by aqueous cleaning solutions. The present MCT compositions can remove a hydrophobic toxin from a surface, by spraying or applying the MCT composition to the surface and wiping off any excess, whereby some or all of the toxin is removed.

After spraying or application, the MCT compositions described herein can be odor-free, a feature that is highly useful when lubricating a household object, which may be in a living space such as a living room, dining room, or kitchen. It is known that when applied in a home (e.g., dining room, living room, or kitchen), petroleum-based lubricants can have a persistent, lingering, and untasteful odor, and solvents associated with such products can be toxic at sufficient levels. However, after application of the present MCT compositions, the ethanol or other nontoxic volatile solvent quickly evaporates, leaving behind an odor free residue of MCT oil.

Household lubricants can be distinguished from industrial lubricants in that industrial lubricants, but not household lubricants, are formulated for effective lubrication and longevity of use at temperatures of up to 90° C. or more, and are generally used on ferrous and non-ferrous machine parts continuously moving over one another, e.g., engine parts, pump motors and the like. For such purposes, many different additives are routinely added to industrial lubricants for their performance enhancement characteristics. For example, automotive engine lubricants may contain several additives that function during and after hot engine operation to protect the lubricant against wax crystallization, viscosity loss at high temperature, lubricant oxidation at low and high temperatures, and to protect the engine against film deposits, corrosion, combustion byproducts, and engine wear. In comparison, household lubricants are generally formulated to function under intermittent or periodic use, typically indoors at ambient temperatures seldom exceeding 40° C., or outdoors in summer heat at temperatures rarely exceeding 50° C. Therefore, household lubricants need not have the same high temperature stability or oxidative resistance properties demanded of industrial lubricants. In evaluating oils for possible use in a household lubricant, common vegetable oils such as those used in baking, frying or in salad oils are found to be too susceptible to environmental degradation to be useful as household lubricants, i.e., degradation through oxidation, polymerization, hydrolysis, and/or rancidification upon exposure to ambient air and humidity over a period of months. By comparison, the MCT based household lubricant compositions described herein, have been found to be broadly and quite remarkably suitable for cleaning, lubricating, and coating in the household environment. Notwithstanding their household uses, the present MCT based compositions can also find use as industrial lubricants in certain contexts, such as where toxicity must be avoided and where the lubrication and durability requirements are satisfied by the MCT compositions.

A method of making a liquid household lubricant composition can include dissolving an MCT oil in a suitable volatile solvent that is capable of maintaining the MCT oil in a stable, single-phase solution during storage, that provides the required viscosity of the final composition, and that is non-toxic. In embodiments, the method further includes adding at least one antioxidant and at least one metal chelator to the MCT-solvent mixture, or to the solvent prior to adding the MCT oil to the solvent. The one or more antioxidants and one or more metal chelators remain soluble in the final composition during storage. The solvent can be, or include, an alcohol such as anhydrous ethanol, 1-propanol, 2-propanol, or a combination thereof. For example, the antioxidant can include BHA (butylated hydroxyanisole), BHT (butylated hydroxytoluene), TBHQ, propyl gallate, or a combination thereof. Other useful food grade antioxidants include citric acid, ascorbic acid and tocopherols. A preferred antioxidant is TBHQ, wherein TBHQ is present in the composition at a concentration of about 10 ppm or greater, of about 25 ppm or greater, of about 50 ppm or greater, of about 75 ppm or greater, or of about 100 ppm or greater. The concentration of an antioxidant can be in the range from about 10 ppm to about 1000 ppm, in the range from about 10 ppm to about 500 ppm, in the range from about 20 ppm to about 200 ppm, in the range from about 20 ppm to about 400 ppm, in the range from about 30 ppm to about 300 ppm, in the range from about 50 ppm to about 300 ppm, or in the range from about 100 ppm to about 200 ppm. Examples of metal cation chelating agents are citric acid, ascorbic acid, tartaric acid and EDTA. Significantly, certain carboxylic acid-containing molecular species such as citric acid can provide both antioxidant and chelating activities. The liquid household lubricant compositions can be suitable for aerosol or hand spray pump delivery.

For aerosol delivery, the method of preparing the composition further includes addition of an aerosol propellant including a liquified or compressed gas. Examples of non-toxic propellants include but are not limited to nitrogen, nitrous oxide, carbon dioxide, and mixtures thereof. Examples of other propellant gases include but are not limited to propane, butane, isobutane, and other liquified or compressed gases. An aerosol spray container can include an internal pressure chamber that is compressed when the aerosol spray can is filled with a lubricating composition. The pressure chamber can include, for example, compressed air, or a physical force element (e.g., spring, piston, polymer package). The internal pressure chamber can thereby provide pressure to dispense the lubricating composition from the aerosol spray can. The methods of preparing a packaged MCT based lubricant composition can further include sterilization of the composition and parts of the container in contact with the composition, or used for dispensing the composition. Sterilization can be accomplished by using the solvent of the composition itself, e.g., ethanol or isopropanol, or by a separate sterilization step, such as irradiation.

The compositions disclosed herein can be utilized to sterilize a surface at the same time the surface is lubricated, coated, or cleaned. Similarly, the compositions can be used to sanitize or sterilize skin when also conditioning and cleaning the skin. The compositions for use as a skin sanitizer can be provided in a pre-packaged wipe for single-use, or for example, in a container of pre-saturated wipes, in addition to being provided in a squeezable bottle having a cap configured for direct application to skin, or in a bottle fitted with a pump or spray dispenser.

The present MCT compositions can be used in methods for coating, lubricating, cleaning, and protecting household objects such as squeaky door hinges, sticky locks, zippers, rusted parts or parts that are susceptible to rust, toys, bicycle or motorcycle parts, such as chains, cables, or axles, tools, treadmills, counter surfaces, boats, automobiles, appliances and any parts thereof, especially movable parts. In Examples 1-2, MCT compositions were applied to various household surfaces and found to have unexpected advantages over methods using petroleum-derived lubricants. The advantages include excellent penetration, cleaning, and coating without leaving an oily or sticky residue, protection of metallic objects and surfaces from corrosion and rust, as well as simultaneous cleaning and sanitation without exposing the user to toxic fumes or leaving a residue that could be irritating or sensitizing to the skin or dangerous if ingested.

EXAMPLES

Example 1. Use of C8:0/C10:0 MCT Oils as Lubricant, Cleaner, and Surface Coating Lubricity and coating tests were conducted comparing the efficacy of two MCT oils with: (i) one MCPG oil, (ii) two commercial vegetable oils (high oleic sunflower oil and olive oil), (iii) a petroleum derived pharmaceutical grade mineral oil (CAS number 8012-47-5) and (iv) the petroleum-based lubricant, WD-40® (WD-40 Company, Inc., San Diego, CA). MCT and MCPG oils were obtained from Stepan Specialty Products (Maywood, NJ) and were selected based on their contents by weight of C8:0+C10:0 fatty acids respectively. They included the MCT oils Neobee® 895 (97% C8:0+2% C10:0) and Neobee® 1053 (55% C8:0+44% C10:0). The single MCPG oil was Neobee® M-20 (70% C8:0+27% C10:0).

Upon testing the various lubricants listed above, it was found that when used as a household lubricant for door hinges and for mechanical shop tools, or alternatively as a protective coating film on both wooden cutting boards and on a stainless steel refrigerator door, the two MCT oils performed better than any of the others above. These included the MCPG oil, olive oil, high oleic sunflower oil, the mineral oil, and the WD-40® spray lubricant. The superior performance of the two MCT oils was evident as follows: Comparing the MCT oils as lubricants to the vegetable oils, the MCT oils with their lower viscosities flowed more easily and penetrated more readily into narrow cracks and spaces where lubricity between closely opposed metal surfaces is required (e.g., into screw threads, and door hinges). This advantage was likely attributable to the lower molecular weight and lower viscosity of the MCT oils with their 8 and 10 carbon fatty acid chains compared to the 18 carbon chains of olive and sunflower oils. For example, while the MCT oils typically have kinematic viscosities of 10-15 cSt at 40° C., or 25-35 cSt at 20° C., the olive and sunflower oil viscosities are approximately 60-80 cSt at 20° C. Furthermore, the 2- to 3-fold lower viscosity of MCT oils when compared to conventional vegetable oils helped facilitate aerosol spray delivery as well as mechanical pump spray delivery of the MCT oils. Where further reduction in the viscosity of MCT oils was required for efficient spray delivery, a non-toxic oil diluent such as anhydrous ethanol that is miscible with the MCT oil was added in an amount sufficient to thin the oil to a viscosity of less than about 10 cSt at 40° C.

As a protective coating applied to an unfinished oak countertop and to a maple cutting board, an MCT oil (Neobee 895) formed water-repellent coatings that were non-tacky with a non-oily hand-feel. These coatings differed from water-repellent coatings formed on the same wooden surfaces using sunflower oil or mineral oil, in which the latter two felt somewhat tacky and/or oily to the touch. Even after applying coatings to a non-porous stainless steel door surface with the above oils and wiping away any free/excess oil, only the MCT oils (Neobee 895 and 1053) left non-oily films.

As a household cleaner and protective coating, it was found that the MCT oils, with their shorter chain fatty acids and smaller molecular size, acted more aggressively and more rapidly as solvents than conventional vegetable oils. The MCT oils more effectively removed greasy residues such as those around stoves and on cookware and removed scuffmarks, fingerprints, and a variety of other markings from hard surfaces. Additionally, a thin MCT oil film applied to a non-porous surface such as a stainless steel refrigerator door tended to remain more lint-free, less tacky, and possessed better hand feel than the same surface coated with a conventional vegetable oil. Food preparation and storage surfaces including wooden countertops, cutting boards, and salad bowls remained food-safe and could be safely cleaned and/or protected with MCT oil, which is an edible oil. Wooden surfaces that are generally somewhat porous were rendered water-repellent with a coating of MCT oil. Such wooden surfaces also assumed an agreeable silky hand feel without any tackiness to touch that would otherwise follow application of a conventional vegetable oil to wood.

Example 2. Lubricity Testing of Petroleum-Derived and Vegetable-Derived Oils To compare the lubricities of MCT, petroleum, and vegetable oils, a tribology testing device was assembled to measure sliding friction. The device measured the resistance of one metal surface to commence sliding over a second metal surface when a variety of lubricants were applied as thin films to the metal surfaces. More specifically, the device employed a long flat strip of aluminum (measuring 18 in. long×2 in. wide) that had been roughened with coarse sandpaper and mounted on a large protractor goniometer to provide a variable angle testing slope. The goniometer allowed the aluminum strip to be tilted and secured at any desired angle thereby providing a calibrated variable angle testing slope. Using this controllable angular slope, the ability of a small rectangular portion of steel flat stock (the "slider") to commence sliding movement was tested. That is, the minimum slope angle needed to initiate slider movement under the force of gravity was measured. The slider, weighing 50 g and measuring 4.3 cm long×2.4 cm wide×0.6 mm thick, was roughened with coarse sandpaper to increase friction with the testing slope. Testing was initiated without any lubricant using the bare metal surfaces that had been cleaned with detergent, then rinsed thoroughly with water and dried. Subsequently, a variety of lubricants were separately tested by applying a light coating of each lubricant to both the testing slope and the slider surfaces that had been thoroughly washed and dried. Before slide-testing of each lubricant, any free liquid lubricant remaining on the metal surfaces was removed by lightly buffing with a soft clean paper towel. This wiping action eliminated any possible adhesion between the metal surfaces that could be caused by a free liquid lubricant, while still leaving a lubricating film on the metal surfaces. The goniometer device described herein with its calibrated adjustable testing slope, allowed comparison of the resistance to sliding resulting from different degrees of friction between non-lubricated versus lubricated hard surfaces, e.g., flat metal surfaces. Depending upon the efficacy of a lubricant, sliding friction could be very substantially reduced.

The testing device that was assembled and its method for measuring sliding friction utilizes essentially the same physics as the "Tilt Table" testing device produced by Agr International, Inc. (Butler, PA, see: agrintl.com/wp-content/uploads/2016/03/TT_2_redesign.pdf). That commercial Tilt Table device measures the surface lubricity of containers, and the testing procedure as used with cylindrical cans or bottles is described as follows: "Three containers are placed on the table in a pyramidal configuration. After the start button is pushed, an electric motor increases the angle of inclination of the table. The bottom two containers are constrained and do not move during testing. When the tilt angle becomes great enough to overcome the frictional forces between the containers, the top container begins to slide and will contact the trip bar." A greater tilt angle is registered when greater frictional resistance to sliding exists between the surfaces of adjacent containers. The testing device that was assembled was manually operated rather than being electrically powered. The manually assembled device and the Agr International (electric) device both operate under the principle that the magnitude of friction between two hard surfaces can be conveniently monitored and compared by measuring the angle of tilting required for one surface to begin sliding over a second surface.

Using the manually assembled device described above, Table 1 provides the goniometer elevation angle readings recorded for the commencement of movement, i.e., sliding of the 50-gram steel slider over the surface of the roughened aluminum test slope described above. Sliding angles were measured both before and after a variety of lubricant films had been applied to the contacting metal surfaces. For measurement accuracy, for whatever goniometer angle at which sliding commenced, the test slope angle was thereafter decreased in 0.5 degree steps to test whether sliding would be inhibited and actually fail to occur at that slightly reduced slope angle. Duplicate measurements (each the result of an average of four repeated slide-tests) are provided in Table 1. The two measurement number averages were obtained on two successive days.

The results (Table 1) indicate that the MCT oils Neobee 895 (caprylic triglycerides) and Neobee 1053 (caprylic/capric triglycerides) provided lubricities on metal surfaces essentially equal to those of the two petroleum-based lubricants (mineral oil and WD-40*). This was surprising because the two MCT oils, with their relatively short aliphatic carbon chains (C8 and C10), were expected to form films on steel and aluminum with lower tenacities and lubricities than the two petroleum oils, with their considerably longer aliphatic carbon chains (ranging from approximately C15 to C50). Further, the lubricities provided by sunflower oil and olive oil were no greater than those of the MCT oils. This was also surprising because the 18 carbon fatty acids of olive and sunflower oils was expected to bind more strongly than the much shorter 8 and 10 carbon fatty acids of MCT oils. Accordingly, MCT oils provided lubricities on metal surfaces similar to those of the longer chain fatty acids in olive oil and sunflower oil based on similar reductions in metal on metal sliding friction evidenced in Table 1.

TABLE 1

Goniometer Sliding Angle Results for Seven Lubricants and Control (None).

| Lubricant: | Goniometer Sliding Angle (degrees) |
|---|---|
| None | 35.0, 37.0 |
| MCT - Neobee 895 | 14.0, 14.5 |
| MCT - Neobee 1053 | 14.0, 14.0 |
| MCPG - Neobee M-20 | 16.0, 16.0 |
| Sunflower Oil-high oleic | 14.0, 14.0 |
| Olive oil | 14.5, 14.0 |
| Mineral Oil-Nujol | 14.0, 14.0 |
| WD-40 ® | 14.0, 13.5 |

In Table 1, each of the "Goniometer Sliding Angle (degrees)" shown was tested for measurement accuracy at whichever goniometer angle sliding commenced. As stated above, the test slope angle was thereafter decreased in 0.5 degree steps to test and thereby determine whether sliding would be prevented by that slightly reduced slope angle. Decreasing each of these test slope angles by as little as 0.5 degrees following each successful steady slider movement on the test slope indeed prevented downward movement by the slider.

In Table 1, the MCPG Neobee M-20 oil (propylene glycol caprylate/caprate) that contains two rather than three C8 and C10 fatty acids appears to be somewhat less lubricious than the two MCT oils. The MCPG oil had a higher goniometer sliding angle at 16 degrees. Product bulletins provided by Stepan Specialty Products list a viscosity of 6 cSt at 40° C. for M-20 that is less than half the viscosities listed for the two MCT oils at the same temperature (12.8 cSt for Neobee 895 and 15.9 cSt for Neobee 1053). The higher viscosities of the two MCT oils compared to the MCPG M-20 oil appeared to provide a more effective lubricating film.

The invention claimed is:

1. A chemically stabilized household lubricant and coating composition comprising:

(i) a medium chain triglyceride (MCT) oil at a concentration of from about 20 weight percent to about 80 weight percent;

(ii) anhydrous alcohol at a concentration of from about 20 weight percent to about 80 weight percent, wherein the anhydrous alcohol is selected from the group consisting of ethanol, n-propanol, and isopropanol;

(iii) an antioxidant at a concentration of from about 50 to about 500 ppm; and (iv) a metal chelating agent at a concentration of from about 20 to about 200 ppm;

wherein the melting point of the composition is below 0° C.;

wherein the kinematic viscosity of the composition is less than about 20 centiStokes (cSt) at 40° C. or less than about 40 cSt at 20° C.; and wherein the composition forms a single homogeneous phase at ambient temperature.

2. The household lubricant and coating composition of claim 1, wherein the weight ratio of the MCT oil to the anhydrous ethanol is from about 1:4 to about 4:1.

3. The household lubricant and coating composition of claim 1, wherein the MCT oil consists essentially of triglycerides having a fatty acid composition of about 20% to about 98% by weight caprylic acid (C8:0), 0% to about 60% by weight capric acid (C10:0), and 0% to about 20% by weight lauric acid (C12:0), wherein the total of said caprylic acid, capric acid, and lauric acid is 100%.

4. The household lubricant and coating composition of claim 3, wherein the weight ratio of C8:0 to C10:0 fatty acids is from about 50:1 to about 1:4.

5. The household lubricant and coating composition of claim 3, wherein the weight ratio of C8:0 to C10:0 fatty acids is from about 2.5:1 to about 1:2.

6. The household lubricant and coating composition of claim 3, wherein the triglycerides are essentially devoid of lauric acid (C12:0).

7. The household lubricant and coating composition of claim 1, wherein the melting point of the composition is about −4° C. or lower.

8. The household lubricant and coating composition of claim 1, wherein the anhydrous alcohol is anhydrous ethanol or denatured ethanol.

9. The household lubricant and coating composition of claim 1, wherein the MCT oil, antioxidant, and metal chelating agent are food grade.

10. The household lubricant and coating composition of claim 1, wherein the antioxidant comprises BHA, BHT, TBHQ, propyl gallate, or a combination thereof.

11. The household lubricant and coating composition of claim 10, wherein the antioxidant is TBHQ present in the composition at a concentration of about 50 ppm to about 200 ppm.

12. The household lubricant and coating composition of claim 1, wherein the metal cation chelating agent comprises citric acid, malic acid, glycolic acid, lactic acid, tartaric acid, ethylenediaminetetraacetic acid (EDTA), or a combination thereof.

13. The household lubricant and coating composition of claim 1, wherein the metal cation chelating agent is citric acid present in the composition at a concentration of about 50 ppm to about 100 ppm.

14. The household lubricant and coating composition of claim 1, wherein the composition is suitable for aerosol delivery or delivery by mechanical pump sprayer.

15. The household lubricant and coating composition of claim 1, wherein the composition is biodegradable, non-toxic, and suitable for use as a household lubricant.

16. The household lubricant and coating composition of claim 1, wherein the composition is suitable for use as a protectant coating of wood or metal articles and/or as a penetrating lubricant.

17. The household lubricant and coating composition of claim 1, wherein the composition is suitable for use as a cleaning agent of wood or metal articles.

18. The household lubricant and coating composition of claim 1, wherein the antioxidant remains soluble in the MCT oil after evaporation of the ethanol.

19. The household lubricant and coating composition of claim 1, wherein the composition consists essentially of said MCT oil, anhydrous ethanol, antioxidant, and metal chelating agent.

20. A lubricant aerosol delivery device, wherein the device comprises the household lubricant and coating composition of claim 1 and an aerosol propellant packaged in a sealed container.

21. The aerosol delivery device of claim 20, wherein the propellant comprises nitrogen, carbon dioxide, nitrous oxide or a combination thereof.

22. A lubricant spray delivery device, wherein the device comprises the household lubricant and coating composition of claim 1 packaged in a pump spray container.

23. A method of lubricating, coating, cleaning, sterilizing, preserving, conditioning, or displacing water from an object or a surface, wherein the method comprises contacting the object or surface with the household lubricant and coating composition of claim 1.

24. The method of claim 23, wherein the household lubricant and coating composition is provided in an aerosol or pump spray delivery device, and wherein the contacting comprises spraying the composition on the object or surface and allowing the anhydrous ethanol to evaporate.

25. The method of claim 23, wherein the object is selected from the group consisting of door hinges, locks, zippers, exercise equipment, rusted parts, toys, bicycle or motorcycle chains, tools, boats, automobiles, and appliances.

* * * * *